US006914565B2

(12) United States Patent
Shikata et al.

(10) Patent No.: US 6,914,565 B2
(45) Date of Patent: Jul. 5, 2005

(54) DUAL BAND ANTENNA WITH INCREASED SENSITIVITY IN A HORIZONTAL DIRECTION

(75) Inventors: Masaru Shikata, Fukushima-ken (JP); Kazuhiro Sasaki, Fukushima-ken (JP); Norio Tanaka, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 7 days.

(21) Appl. No.: 10/753,114

(22) Filed: Jan. 7, 2004

(65) Prior Publication Data

US 2004/0140933 A1 Jul. 22, 2004

(30) Foreign Application Priority Data

Jan. 20, 2003 (JP) ..... 2003-011389

(51) Int. Cl.[7] ..... H01Q 1/38
(52) U.S. Cl. ..... 343/700 MS; 343/702
(58) Field of Search ..... 343/700 MS, 702, 343/846

(56) References Cited

U.S. PATENT DOCUMENTS

| | | | | |
|---|---|---|---|---|
| 5,355,142 | A * | 10/1994 | Marshall et al. | 343/700 MS |
| 5,880,697 | A | 3/1999 | McCarrick et al. | 343/700 MS |
| 6,469,673 | B2 * | 10/2002 | Kaiponen | 343/703 |
| 6,542,123 | B1 * | 4/2003 | Chen | 343/700 MS |
| 6,667,716 | B2 * | 12/2003 | Chen | 343/700 MS |
| 6,680,705 | B2 * | 1/2004 | Tan et al. | 343/702 |
| 6,774,849 | B2 * | 8/2004 | Umehara et al. | 343/700 MS |
| 6,788,257 | B2 * | 9/2004 | Fang et al. | 343/700 MS |
| 6,812,891 | B2 * | 11/2004 | Montgomery et al. | 343/700 MS |
| 6,831,607 | B2 * | 12/2004 | Hebron et al. | 343/700 MS |
| 2002/0149523 | A1 | 10/2002 | Fang et al. | 343/700 MS |

FOREIGN PATENT DOCUMENTS

| | | |
|---|---|---|
| DE | 23 60 216 A1 | 6/1975 |
| DE | 201 06 005 U1 | 10/2001 |
| JP | 590828 | 4/1993 |
| JP | 10-93332 | 4/1998 |
| JP | 2003-101336 | 4/2003 |

* cited by examiner

*Primary Examiner*—Tan Ho
(74) *Attorney, Agent, or Firm*—Brinks Hofer Gilson & Lione

(57) ABSTRACT

A dual band antenna contains a first radiating conductor plate disposed substantially parallel to a grounding conductor, a power-supplying conductor plate extending downwards from the first radiating conductor plate, a connecting conductor plate for connecting the first radiating conductor plate to the grounding conductor, a second radiating conductor plate provided upright beneath the first radiating conductor plate and having a substantially wedge-shaped, elastically deformable portion, and a synthetic resin adjusting screw threaded to the first radiating conductor plate for depressing the top portion of the second radiating conductor plate downwards. The first and second radiating conductor plates resonate at first and second frequencies respectively (with $f_2>f_1$). The gap between the second radiating conductor plate and the first radiating conductor plate can be changed.

4 Claims, 5 Drawing Sheets

DUAL BAND ANTENNA WITH INCREASED SENSITIVITY IN A HORIZONTAL DIRECTION

This application claims the benefit of priority to Japanese Patent Application No. 2003-011389, herein incorporated by reference.

BACKGROUND OF THE INVENTION

1. Field of the Invention

The present invention relates to a small-sized, dual band antenna capable of transmitting and receiving signal waves of two type frequency bands and adapted for easier assembly with a car-mounted communication device.

2. Description of the Related Art

Conventionally, as a dual band antenna suitable for miniaturization, an inverted F type antenna that can resonate with two kinds of frequencies, i.e., high and low frequencies by the action of notch portions provided on a radiating conductor plate (refer to Patent Document 1), has been proposed.

FIG. 5 illustrates a conventional example. In FIG. 5, an inverted F type dual band antenna 1 includes a radiating conductor plate 2 with a rectangular notch portion 4. The radiating conductor plate 2 has an L-shaped conductor piece 2*a* resonating at a first frequency $f_1$ and a rectangular conductor piece 2*b* resonating at a second frequency $f_2$ that is higher than the first frequency $f_1$. Extending from one lateral edge of the radiating conductor plate 2 is a conductive connector plate 3, which is mounted upright on a grounding conductor plate 5 so that the radiating conductor plate 2 can be electrically connected to the grounding conductor plate 5. The entire surface of the radiating conductor plate 2 is spaced apart from the grounding conductor plate 5 at a predetermined gap (the height of the conductive connector plate 3). A power-supplying pin 6 is soldered to a given position on the radiating conductor plate 2. The power-supplying pin 6 is connected to an antenna circuit not shown in the figure, without making contact with the grounding conductor plate 5.

In the conventional dual band antenna 1 of the construction as stated above, the L-shaped conductor piece 2*a* has a length along the extending direction thereof equal to approximately a quarter of the resonance length $\lambda_1$ corresponding to the first frequency $f_1$, and the rectangular conductor piece 2*b*, which extends shorter than the L-shaped conductor piece 2*a*, has a length equal to approximately a quarter of the resonance length $\lambda_2$ ($\lambda_2<\lambda_1$) corresponding to the second frequency $f_2$. For this reason, this assures that, when a predetermined high frequency electrical power is supplied to the radiating conductor plate 2 through the power-supplying pin 6, the conductor pieces 2*a* and 2*b* can resonate at mutually different frequencies, thereby making it possible to transmit and receive signal waves of two kinds of frequency bands, i.e., high and low frequency bands.

[Patent Document 1]

Japanese Unexamined Patent Application Publication No. 10-93332 (pages 2 to 3, FIG. 1)

In the conventional dual band antenna illustrated in FIG. 5, the electrical waves emitted from the L-shaped conductor piece 2*a* at the time of resonating at the first frequency $f_1$ have directivity as shown in FIG. 6A which assures increased gain in the horizontal direction as well as in the upward direction. However, electrical waves emitted from the rectangular conductor piece 2*b* at the time of resonating at the second frequency $f_2$, which is higher than the first frequency, have directivity biased upwards, as shown in FIG. 6B, which leads to reduced gain in the horizontal direction. Because a car-mounted communication device often receives and transmits horizontally advancing signal waves, employing the conventional dual band antenna 1 as a car-mounted communication antenna may result in the electrical waves of the second frequency $f_2$ being used incompletely. Particularly, sensitivity will be dramatically reduced in cases where the resonance frequency of the rectangular conductor piece 2*b* deviates from the predetermined second frequency $f_2$. In practical application, resonance frequency often deviates from a predetermined value under the influence of an antenna mounting bracket, etc., and it is difficult to correct such deviation in the conventional dual band antenna 1.

SUMMARY OF THE INVENTION

The present invention has been finalized in view of the drawbacks inherent in the conventional antenna, and it is an object of the present invention to provide a dual band antenna that assures increased sensitivity in the horizontal direction at two frequency bands, high and low frequency bands.

To achieve this object, a dual band antenna is provided which comprises the following components: a support substrate with a grounding conductor; a first radiating conductor plate arranged substantially parallel to the grounding conductor; a power-supplying conductor plate extending downwards from the first radiating conductor plate and adapted to be supplied with high frequency power of a first frequency at its bottom portion; a connecting conductor plate for connecting the first radiating conductor plate to the grounding conductor; and a second radiating conductor plate provided upright with respect to the grounding conductor, the second radiating conductor plate facing the underside of the first radiating conductor plate at its top portion and adapted to be supplied, at its bottom portion, with high frequency power of a second frequency that is higher than the first frequency, wherein the second radiating conductor plate is so constructed that the gap between the top portion of the second radiating conductor plate and the first radiating conductor plate can be changed.

According to the dual band antenna constructed above, by supplying high frequency power of a first frequency to the bottom portion of the power-supplying conductor plate, the first radiating conductor plate will be resonated like an inverted F type antenna, thus making it possible to obtain a radiation pattern with an increased gain in the horizontal direction. Moreover, by feeding the high frequency power of a second frequency to the bottom portion of the second radiating conductor plate, the second radiating conductor plate will be resonated like a monopole antenna so that a radiation pattern with an increased gain in the horizontal direction can be attained. This assures good sensitivity in the horizontal direction regardless of whether resonance occurs at the high frequency or the low frequency. Furthermore, it becomes possible to reduce the height of the second radiating conductor plate and thereby make the overall profile of the antenna low, because the first radiating conductor plate facing the top portion of the second radiating conductor plate serves as a capacitive load during resonance of the second radiating conductor plate. In addition, the resonance frequency of the second radiating conductor plate can be adjusted in a simple and precise manner, due to the fact that the degree of capacity coupling between the first and second radiating conductor plates may be changed by way of altering the gap between the top portion of the second radiating conductor plate and the first radiating conductor plate.

As an arrangement for changing the gap between the top portion of the second radiating conductor plate and the first radiating conductor plate, it may be contemplated, for example, that the second radiating conductor plate has an elastically deformable portion at its local area and a synthetic resin adjusting screw is threaded to the first radiating conductor plate for depressing the top portion of the second radiating conductor plate downwards. Using this arrangement, if the adjusting screw is loosened, the second radiating conductor plate moves away from the first radiating conductor plate to lower the resonance frequency. To the contrary, if the adjusting screw is tightened, the second radiating conductor plate moves toward the first radiating conductor plate to increase the resonance frequency. Interconnecting the first and second radiating conductor plates through the adjusting screw in this fashion will improve mechanical strength, meaning that the radiating conductor plates are hardly deformed even though external vibration and shock are applied thereto.

It may also be contemplated that the second radiating conductor plate is composed of an upright conductor part erected on the support substrate and a sliding conductor part slidable in an up-and-down direction with respect to the upright conductor part and further comprises a fastening means, such as a bolt-and-nut, for fastening the upright conductor part to the sliding conductor part so that it is possible to change the gap between the top portion of the second radiating conductor plate and the first radiating conductor plate. With this construction, by altering the position at which the sliding conductor part is secured to the upright conductor part, the gap between the sliding conductor part and the first radiating conductor plate can be changed and therefore the resonance frequency of the second radiating conductor plate can be adjusted with ease.

It would also be preferred that the top portion of the second radiating conductor plate be bent in a direction substantially parallel to the first radiating conductor plate, thereby increasing the capacity value between the top portion of the second radiating conductor plate and the first radiating conductor plate.

DESCRIPTION OF THE PREFERRED EMBODIMENT

Figure 1:
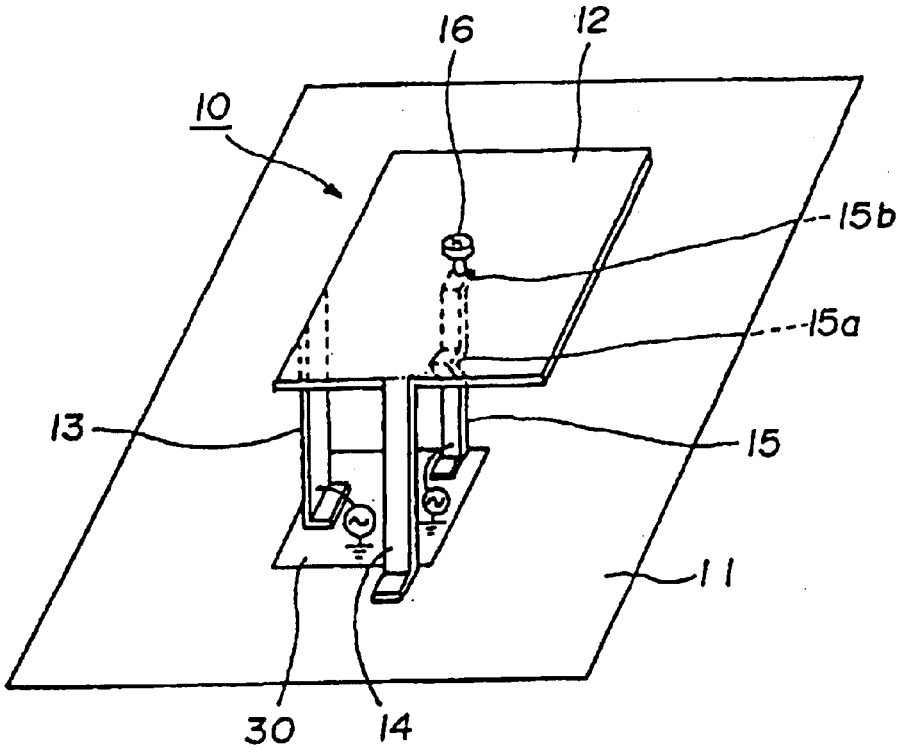
FIG. 1 is a perspective view of a dual band antenna according to a preferred embodiment of the present invention.

Certain preferred embodiments of the present invention will now be described with reference to the drawings. FIG. 1 is a perspective view of a dual band antenna according to a preferred embodiment of the present invention, FIG. 2 is a side elevational view of the dual band antenna shown in FIG. 1, and FIG. 3 is a characteristic view illustrating the radiation pattern of the dual band antenna shown in FIG. 1.

Figure 2:
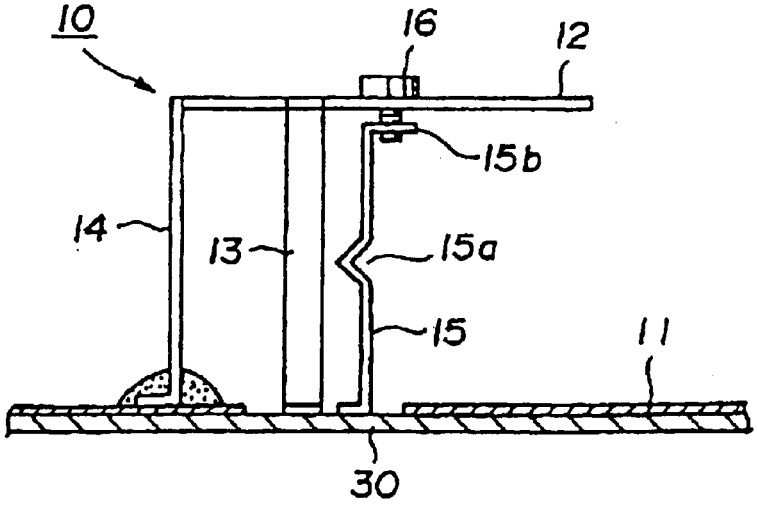
FIG. 2 is a side elevational view of the dual band antenna shown in FIG. 1.

Referring to FIGS. 1 and 2, the dual band antenna 10 is a small-sized antenna adapted to operate both as an inverted F type antenna and a monopole antenna. The dual band antenna 10 is produced by way of mounting a press-formed, metallic conductor sheet (a copper sheet, for instance) of a predetermined configuration onto a grounding conductor 11 that is provided on the entire surface of a support substrate 30 in the form of, e.g., a copper foil. The dual band antenna 10 comprises a first radiating conductor plate 12 disposed substantially parallel to the grounding conductor 11, an elongated power-supplying conductor plate 13 and a connecting conductor plate 14, each extending downwards from two suitable portions of the first radiating conductor plate 12, a second radiating conductor plate 15 provided upright beneath the first radiating conductor plate 12 and having an elastically deformable portion 15*a* of a substantially wedge shape, and a synthetic resin adjusting screw 16 threaded to a substantially central portion of the first radiating conductor plate 12 in such a manner that it can depress the top portion of the second radiating conductor plate 15 downwards.

Power-supplying lines, such as coaxial cables, not shown in the drawings, are respectively connected to the bottom end portions of the power-supplying conductor plate 13 and the second radiating conductor plate 15 so that high frequency power of a first frequency $f_1$ can be supplied to the first radiating conductor plate 12 through the power-supplying conductor plate 13 and, at the same time, high frequency power of a second frequency $f_2$ that is higher than the first frequency $f_1$ can be supplied to the second radiating conductor plate 15. In addition, the first radiating conductor plate 12 is so sized and shaped that it can be resonated at the first frequency $f_1$ and, similarly, the second radiating conductor plate 15 is so sized and shaped that it can be resonated at the second frequency $f_2$. The second radiating conductor plate 15 is provided at its top portion with a receiving part 15*b* bent substantially parallel to the first radiating conductor plate 12. The receiving part 15*b* maintains a capacity coupling with the first radiating conductor plate 12 so that the first radiating conductor plate 12 can become a capacitive load and serve as a shortened capacitor when the second radiating conductor plate 15 is being resonated.

Although the power-supplying conductor plate 13 and the second radiating conductor plate 15 are disposed in a region where they do not make any contact with the grounding conductor 11, the bottom end portion of the connecting conductor plate 14 remains soldered to the grounding conductor 11 to ensure that the first radiating conductor plate 12 is electrically connected to the grounding conductor 11 via the connecting conductor plate 14. The connecting conductor plate 14 is provided at an optimum position where the mismatching of impedance can be avoided.

Figure 3A:
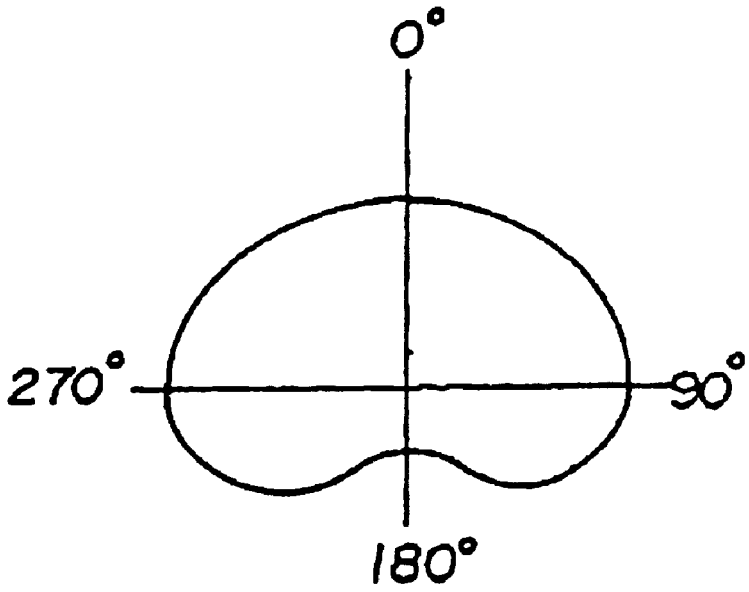
FIG. 3 is a characteristic view illustrating the radiation pattern of the dual band antenna shown in FIG. 1.
Figure 3B:
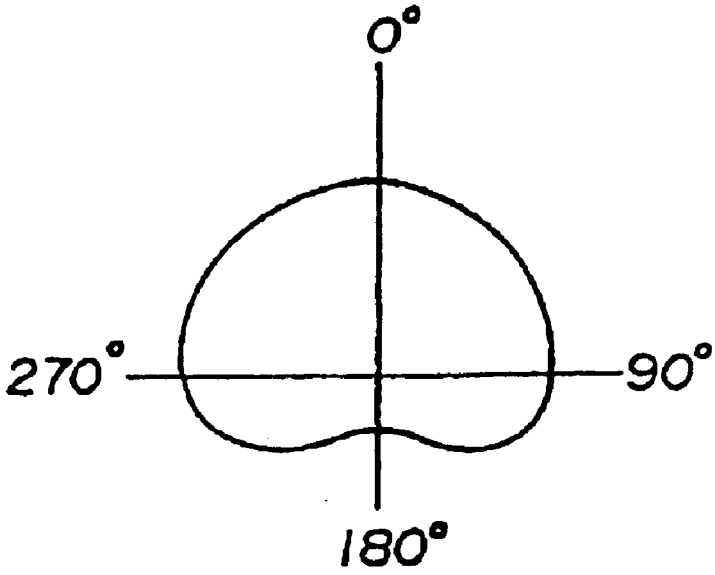

The dual band antenna 10 as constructed above enables the first radiating conductor plate 12 to resonate as an inverted F type antenna by feeding high frequency power of a first frequency $f_1$ to the power-supplying conductor plate 13. At this time, electric waves emitted from the first radiating conductor plate 12, which is resonating at the first frequency $f_1$, will have directivity in the radiating pattern, as shown in FIG. 3A, assuring an increased gain in the horizontal direction. In the meantime, the second radiating conductor plate 15 is caused to resonate as a monopole antenna by feeding high frequency power of a second frequency $f_2$ thereto. At this moment, electric waves emitted from the second radiating conductor plate 15, which is resonating at the second frequency $f_2$, will have directivity in the radiating pattern as shown in FIG. 3B, thus assuring an increased gain in the horizontal direction.

In addition, it is possible to reduce the height of the second radiating conductor plate 15 and to make the overall profile of the antenna low, because the first radiating conductor plate 12, facing the top portion (receiving portion 15*b*) of the second radiating conductor plate 15, serves as a capacitive load during resonance of the second radiating conductor plate 15. In addition, the resonance frequency of the second radiating conductor plate 15 can be adjusted in a simple and precise manner, due to the fact that the degree of capacity coupling between the first and second radiating conductor plates 12, 15 may be changed by way of tightening or loosening the adjusting screw 16 and thus altering the gap between the receiving portion 15*b* of the second radiating conductor plate 15 and the first radiating conductor plate 12. More specifically, if the adjusting screw 16 is tightened, the elastically deformable portion 15*a* of a substantially wedge shape will be depressed and bent to make the receiving portion 15*b* descend, with the result that the second radiating conductor plate 15 moves gradually away from the first radiating conductor plate 12, thereby weakening the degree of the capacity coupling and lowering the resonance frequency. To the contrary, if the adjusting screw 16 is loosened, the receiving portion 15*b* will ascend by the resilient force of the elastically deformable portion 15*a*, ensuring that the second radiating conductor plate 15 moves gradually toward the first radiating conductor plate 12, thereby strengthening the degree of the capacity coupling and increasing the resonance frequency.

Moreover, interconnecting the first and second radiating conductor plates 12, 15 through the adjusting screw 16 in this fashion will improve the mechanical strength of the first and second radiating conductor plates 12, 15 so that the radiating conductor plates 12, 15 are hardly deformed even though external vibration and shock are applied thereto. For this reason, the dual band antenna 10 exhibits excellent sensitivity in the horizontal direction for both types of resonance of high frequency and low frequency and has an enhanced anti-vibration and anti-shock property, which makes it possible to obtain an antenna performance suitable for use in car-mounted communication devices.

According to this embodiment, if the top portion (receiving portion 15*b*) of the second radiating conductor plate 15 confronts with a substantially central portion of the first radiating conductor plate 12, directivity at the time of resonance of the second radiating conductor plate 15 is weakened in the upward direction and strengthened in the horizontal direction, which is advantageous in improving the sensitivity in the horizontal direction.

Figure 4:
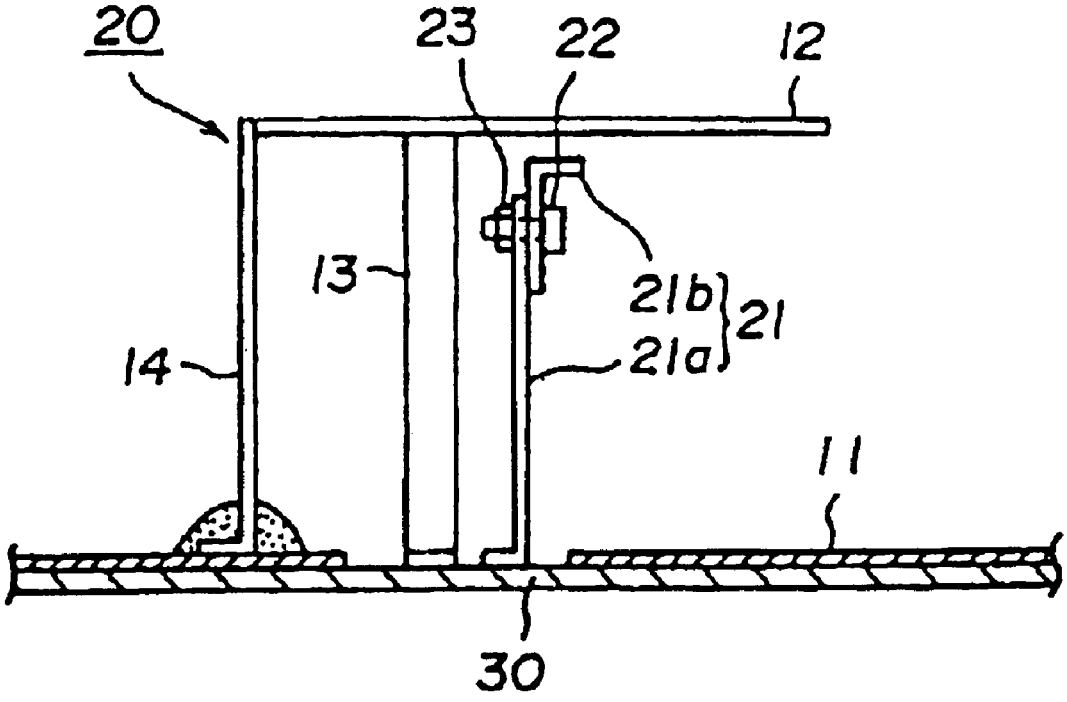
FIG. 4 is a side elevational view of the dual band antenna according to another embodiment of the present invention.
Figure 5:
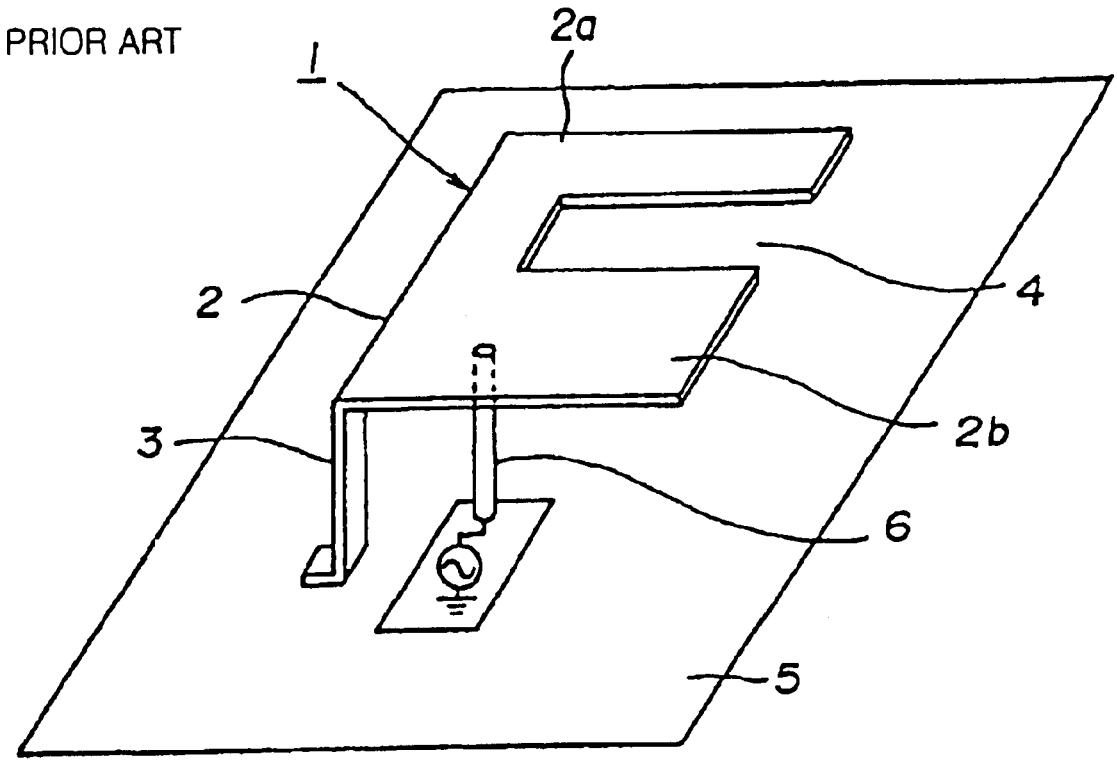
FIG. 5 is a perspective view of the conventional dual band antenna.
Figure 6A:
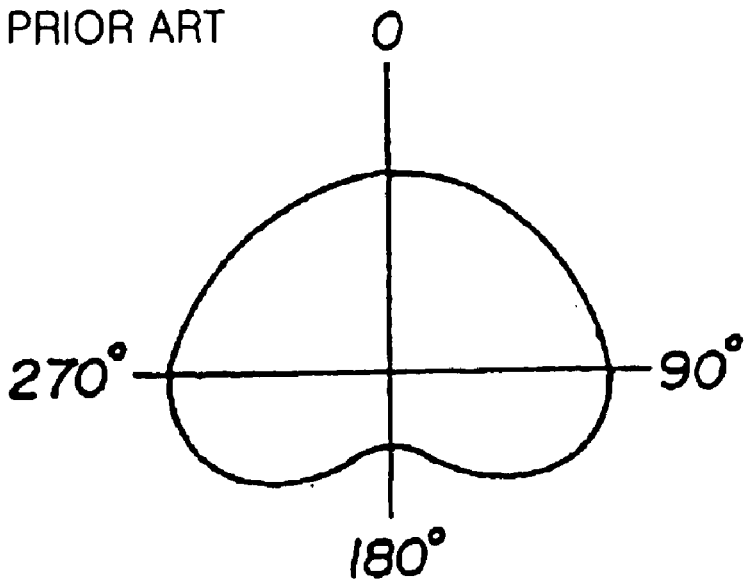
FIG. 6 is a characteristic view illustrating the radiation pattern of the dual band antenna shown in FIG. 5.
Figure 6B:
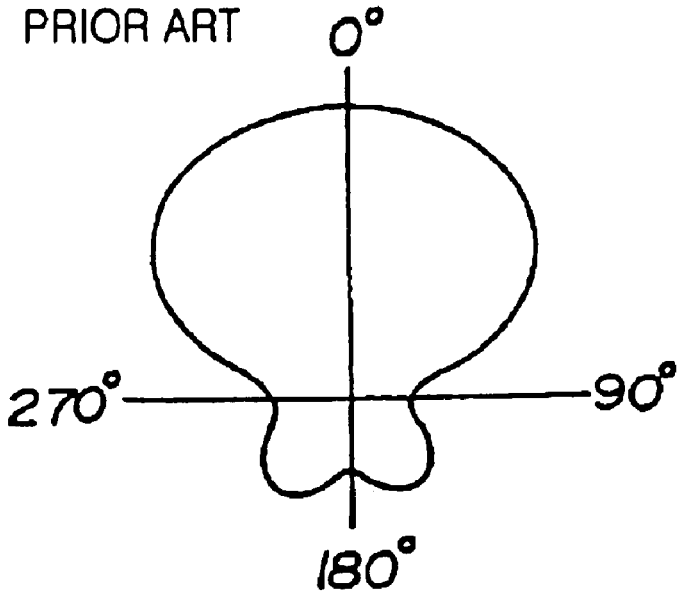

A dual band antenna according to another embodiment of the present invention is shown in FIG. 4 as a side elevational view. The parts that are the same as those in FIGS. 1 and 2 are designated by the same reference numerals, and therefore a description thereof will be omitted in order to avoid redundancy.

The dual band antenna 20 illustrated in FIG. 4 is provided with a second radiating conductor plate 21, which resonates as a monopole antenna, of a construction dramatically different from the one in the preceding embodiment. In other words, in this embodiment, the second radiating conductor plate 21 is composed of an upright conductor part 21*a* erected on a support substrate 30, and a substantially L-shaped sliding conductor part 21*b* slidable in an up-and-down direction with respect to the upright conductor part 21*a*. The upright conductor part 21*a* and the sliding conductor part 21*b* are fastened by way of a fastening means that consists of a bolt 22 and a nut 23. In addition, the upright conductor part 21*a* and the sliding conductor part 21*b* are provided with through-holes (not shown) for receiving the bolt 22, one of the through-holes being a vertically extending slot. Therefore, this arrangement makes it possible to vertically displace the position at which the sliding conductor part 21*b* is attached to the upright conductor part 21*a*, thus changing the degree of capacity coupling that depends on the gap between the sliding conductor part 21*b* and the first radiating conductor plate 12. This means that the resonance frequency of the second radiating conductor plate 21 can be adjusted readily as in the preceding embodiment.

In addition, the dual band antenna 20 according to this embodiment is also provided with a synthetic resin screw member threaded to the first radiating conductor plate 12 for depressing the top portion of the sliding conductor part 21*b* downwards, thereby improving the mechanical strength of the first and second radiating conductor plates 12 and 21.

Although the top portion of each of the second radiating conductor plates 15, 21 is bent substantially parallel to the first radiating conductor plate 12 in both of the embodiments set forth above, it is possible to operate the second radiating conductor plates 15, 21 as a monopole antenna even though the top portion is not bent. Nevertheless, if the top portion of the second radiating conductor plates 15, 21 in this manner is bent, it is possible to increase the capacity value between the top portion and the first radiating conductor plate 12, thereby assuring easier adjustment of resonance frequency while providing a low-profile antenna.

The present invention can be carried out in the modes according to the above embodiments and provide the following beneficial effects.

In the dual band antenna, the first radiating conductor plate can be resonated as an inverted F type antenna while the second radiating conductor plate can be resonated as a monopole antenna. As a result, enhanced sensitivity in the horizontal direction is attainable for two kinds of resonance, high frequency resonance and low frequency resonance. Furthermore, it is possible to reduce the height of the second radiating conductor plate and to make the overall profile of the antenna low, because the first radiating conductor plate facing the top portion of the second radiating conductor plate serves as a capacitive load during resonance of the second radiating conductor plate. In addition, the resonance frequency of the second radiating conductor plate can be adjusted in a simple and precise manner by way of altering the gap between the top portion of the second radiating conductor plate and the first radiating conductor plate and thus changing the degree of capacity coupling between the first and second radiating conductor plates.

What is claimed is:

1. A dual band antenna comprising:

a support substrate with a grounding conductor;

a first radiating conductor plate arranged substantially parallel to the grounding conductor;

a power-supplying conductor plate extending downwards from the first radiating conductor plate and adapted to be supplied with high frequency power of a first frequency at a bottom portion of the power-supplying conductive plate;

a connecting conductor plate for connecting the first radiating conductor plate to the grounding conductor; and a second radiating conductor plate provided upright with respect to the grounding conductor, the second radiating conductor plate facing an underside of the first radiating conductor plate at a top portion of the second radiating conductor plate and adapted to be supplied, at a bottom portion of the second radiating conductor plate, with high frequency power of a second frequency that is higher than the first frequency, wherein the second radiating conductor plate is so constructed that a gap between the top portion of the second radiating conductor plate and the first radiating conductor plate can be changed.

2. The dual band antenna according to claim 1, wherein the second radiating conductor plate has an elastically deformable portion, and further comprising a synthetic resin adjusting screw threaded to the first radiating conductor plate for depressing the top portion of the second radiating conductor plate downwards.

3. The dual band antenna according to claim 1, wherein the second radiating conductor plate is composed of an upright conductor part erected on the support substrate and a sliding conductor part slidable in an up-and-down direction with respect to the upright conductor part, and further comprising a fastening means for fastening the upright conductor part to the sliding conductor part.

4. The dual band antenna according to claim 1, wherein the top portion of the second radiating conductor plate is bent in a direction substantially parallel to the first radiating conductor plate.

* * * * *